US007108490B2

(12) United States Patent
Noh et al.

(10) Patent No.: US 7,108,490 B2
(45) Date of Patent: Sep. 19, 2006

(54) RECIPROCATING COMPRESSOR HAVING ANTI-COLLISION MEANS

(75) Inventors: Ki-Won Noh, Seoul (KR); Jong-Tae Heo, Bucheon (KR)

(73) Assignee: LG Electronics Inc., Seoul (KR)

( * ) Notice: Subject to any disclaimer, the term of this patent is extended or adjusted under 35 U.S.C. 154(b) by 156 days.

(21) Appl. No.: 10/383,628

(22) Filed: Mar. 10, 2003

(65) Prior Publication Data

US 2003/0170129 A1 Sep. 11, 2003

(30) Foreign Application Priority Data

Mar. 11, 2002 (KR) ..... 10-2002-0013004

(51) Int. Cl.
*F04B 17/04* (2006.01)

(52) U.S. Cl. ..... 417/417

(58) Field of Classification Search ..... 417/415, 417/416, 417

See application file for complete search history.

(56) References Cited

U.S. PATENT DOCUMENTS 4,905,574 A * 3/1990 Trevisan ..... 92/69 R
6,077,054 A * 6/2000 Lee et al. ..... 417/417
6,203,292 B1 * 3/2001 Morita et al. ..... 417/417
6,540,490 B1 * 4/2003 Lilie ..... 417/416

FOREIGN PATENT DOCUMENTS

| | | |
|---|---|---|
| CN | 1326051 | 12/2001 |
| DE | 9312752 | 12/1993 |
| DE | 10055954 | 12/2001 |
| KR | 10-2000-0040150 | 7/2000 |

OTHER PUBLICATIONS

English Language Abstract of KE 10-2000-0040150.

* cited by examiner

*Primary Examiner*—Charles G. Freay
(74) *Attorney, Agent, or Firm*—Greenblum & Bernstein, P.L.C.

(57) ABSTRACT

A reciprocating compressor includes a frame unit disposed in a container; a reciprocating motor disposed in the frame unit; a cylinder disposed in the frame unit; a piston performing a linear reciprocating motion; a valve unit installed at the front of the frame unit and the piston so as to suck/discharge gas; and a front coil spring arranged on the frame unit in order to support the linear reciprocating motion of the piston elastically and prevent breakage of construction parts abutting on the piston when the piston moves over a top dead center.

3 Claims, 6 Drawing Sheets

RECIPROCATING COMPRESSOR HAVING ANTI-COLLISION MEANS

RELATED APPLICATIONS

The present disclosure is related to subject matter contained in Korean Patent Application No. 2002-13004, filed on Mar. 11, 2002.

BACKGROUND OF THE INVENTION

1. Field of the Invention

The present invention relates to a reciprocating compressor, and in particular to a reciprocating compressor which is configured to support a piston elastically and to prevent breakage of the piston and other construction parts abutting on the piston by limiting a stroke distance of the piston by installing elastic members (coil springs) to the front and rear of the piston.

2. Description of the Prior Art

In general, a compressor is for converting mechanical energy into latent energy of compressed fluid. Generally compressors can be classified as a reciprocating type, a scroll type, a centrifugal type and a vane type.

FIG. 1 is a transverse-sectional view illustrating the conventional reciprocating compressor.

As depicted in FIG. 1, the conventional reciprocating compressor includes a container 10 having a certain inner space; a frame unit 30 disposed in the container 10; a reciprocating motor 20 installed in the frame unit 30 in order to generate a driving force; a cylinder 50 installed at the center of the frame unit 30; a piston 60 performing a linear reciprocating motion into and out of the cylinder 50 by the driving force of the reciprocating motor 20; a valve unit 70 installed at the front of the frame unit 30 and the piston 60 so as to suck/discharge gas into the cylinder 50 by using pressure difference generated by the linear reciprocating motion of the piston 60; and a spring unit 80 installed at the frame unit 30 in order to support the linear reciprocating motion of the piston 60 elastically.

The frame unit 30 consists of a front and a rear frames 31, 32 respectively installed at the internal front and the internal rear of the casing 10 and a middle frame 33 installed between the front and the rear frames 31, 32.

The reciprocating motor 20 includes an outer stator 21 fixed between the middle frame 31 and the rear frame 30; an inner stator 22 inserted into the outer stator 21 and spaced therefore by a certain interval; a wound coil 23 wound around the outer stator 21; and a mover 24 installed between the outer stator 21 and the inner stator 22 and connected to the piston 60 so as to perform a linear-reciprocating motion.

The cylinder 50 is horizontally installed at the center of the front frame 40 and maintains a certain interval with respect to the reciprocating motor 20.

The piston 60 is inserted into a through hole 51 of the cylinder 50 so as to form a compression chamber (P), and the end of the piston 60 is connected to the mover 24.

A discharge pipe 2 communicating with the valve unit 70 is installed at the front of the container 10, and a suction or intake pipe 1 is installed at the rear of the container 10.

The valve unit 70 includes a discharge cover 71 for covering the compression chamber (P) of the cylinder 60; a discharge valve 72 arranged inside the discharge cover 71 for opening/closing the compression chamber (P); a valve spring 73 for supporting the discharge valve 72 elastically; and a suction valve 74 combined with the front of the piston 60 and opening/closing a gas suction flow path (F) formed inside the piston 60.

The spring unit 80 includes a spring support 81 directly connected to the rear of the piston 60 or the mover 24; a front coil spring 82 installed between the spring support 81 and the front frame 31; and a rear coil spring 83 installed between the spring support 81 and the rear frame 30.

Hereinafter, the operation of the conventional reciprocating compressor will be described.

When power is supplied to the reciprocating motor 20 and a current flows in the wound coil 23, the mover 24 performs the linear-reciprocating motion by magnetic flux formed by the outer stator 21 and the inner stator 22.

Accordingly, the piston 60 connected to the mover 24 performs the linear-reciprocating motion into the through hole 51 of the cylinder 50.

At the same time, gas is sucked through the suction pipe 1 of the container 10 and the suction flow path (F) of the piston 60, flows into the compression chamber (P) by the operation of the valve unit 70 and is discharged through the discharge pipe 2, and that operation is performed repeatedly.

When the piston 60 reaches a top dead center position (where the piston fully compresses the compression chamber), the spring support 81 is elastically abutted supported by the front coil spring 82. On the contrary, when the piston 60 reaches a bottom dead center position (where the piston fully expands the compression chamber), the spring support 81 is elastically abutted by the rear coil spring 83.

The piston 60 performs the linear-reciprocating motion within a fixed stroke distance, and the linear-reciprocating motion is performed elastically by the front and the rear coil springs 82 and 83.

However, in the conventional reciprocating compressor, when a stroke distance of the piston is not controlled due to an improper operation or an initial position of the piston deviates from a proper position due to fabrication error and assembly error of construction parts, etc., not only the piston but also construction parts abutting on the piston may be damaged due to collision.

SUMMARY OF THE INVENTION

In order to solve the above-mentioned problem, it is an object of the present invention to provide a reciprocating compressor which is configured to support a piston elastically, to limit a stroke distance of the piston and to prevent damage of other construction parts abutting on the piston by installing elastic members at the front and rear of the piston performing a linear-reciprocating motion.

In order to achieve the above-mentioned object, a reciprocating compressor in accordance with the present invention includes a container having a gas suction pipe and a gas discharge pipe; a frame unit disposed in the container; a reciprocating motor disposed in the frame unit in order to generate a driving force; a piston arranged so as to perform a linear reciprocating motion into and out of a cylinder by the driving force of the reciprocating motor; a valve unit installed at the frame unit so as to discharge gas by using pressure difference generated by the linear reciprocating motion of the piston; and a front elastic member arranged on the front of the frame unit in order to support the piston elastically and prevent breakage of construction parts abutting on the piston when the piston moves over a top dead center position.

In addition, a reciprocating compressor in accordance with the present invention includes a container having a gas suction pipe and a gas discharge pipe; a frame unit disposed in the container; a reciprocating motor disposed in the frame unit in order to generate a driving force; a piston arranged so as to perform a linear reciprocating motion into and out of a cylinder by the driving force of the reciprocating motor; a valve unit installed at the frame unit so as to discharge gas by using a pressure difference generated by the linear reciprocating motion of the piston; and a rear elastic member arranged on the rear of the frame unit in order to support the piston elastically and prevent breakage of construction parts abutting on the piston when the piston moves over a bottom dead center.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Hereinafter, the preferred embodiment of a reciprocating compressor in accordance with the present invention will be described in detail with reference to accompanying drawings.

Figure 1:
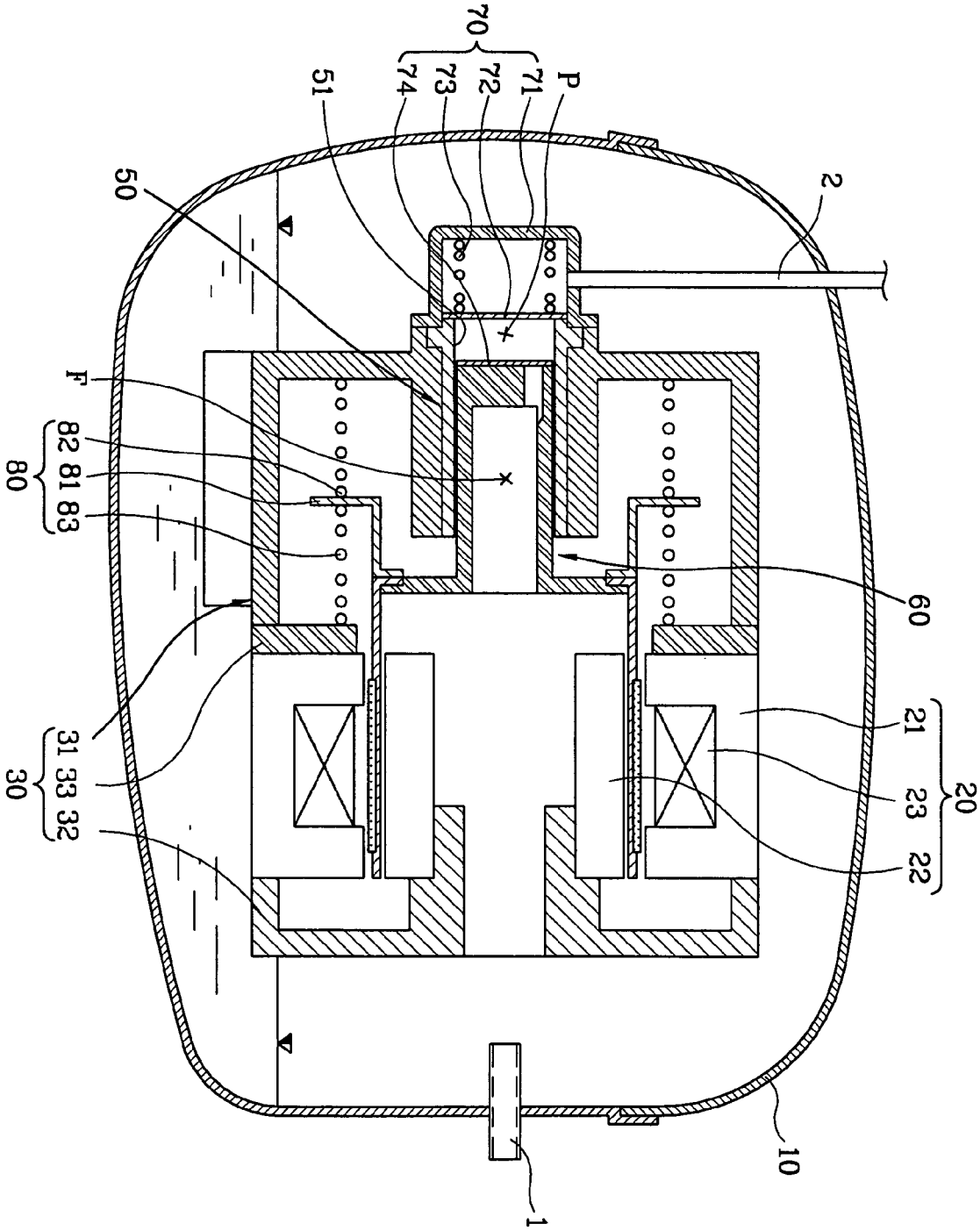
FIG. 1 PRIOR ART
FIG. 1 is a transverse-sectional view illustrating the conventional reciprocating compressor.
Figure 2:
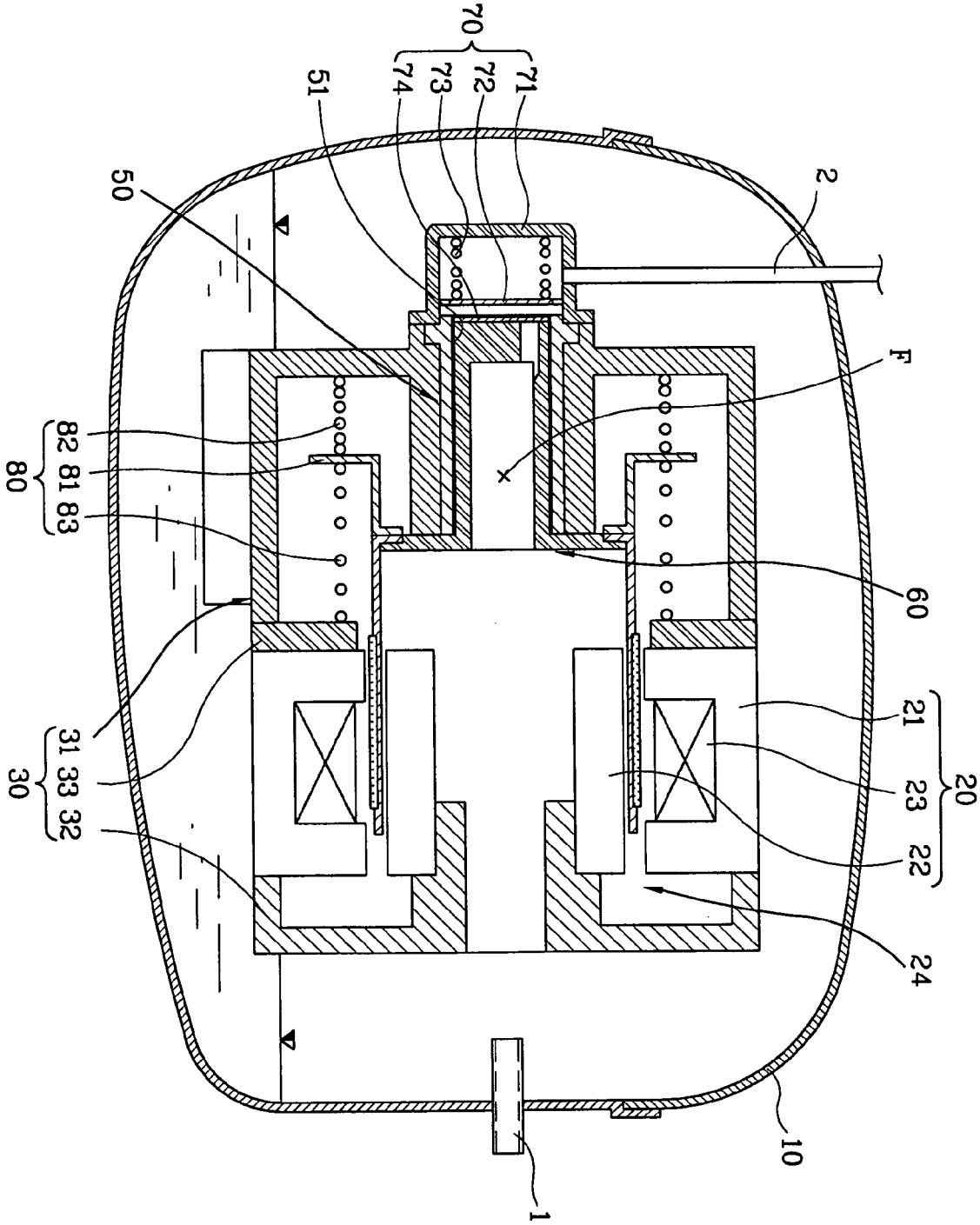
FIG. 2 PRIOR ART
FIG. 2 is a transverse-sectional view illustrating impact of a piston of the reciprocating compressor in FIG. 1 at a top dead center.
Figure 3:
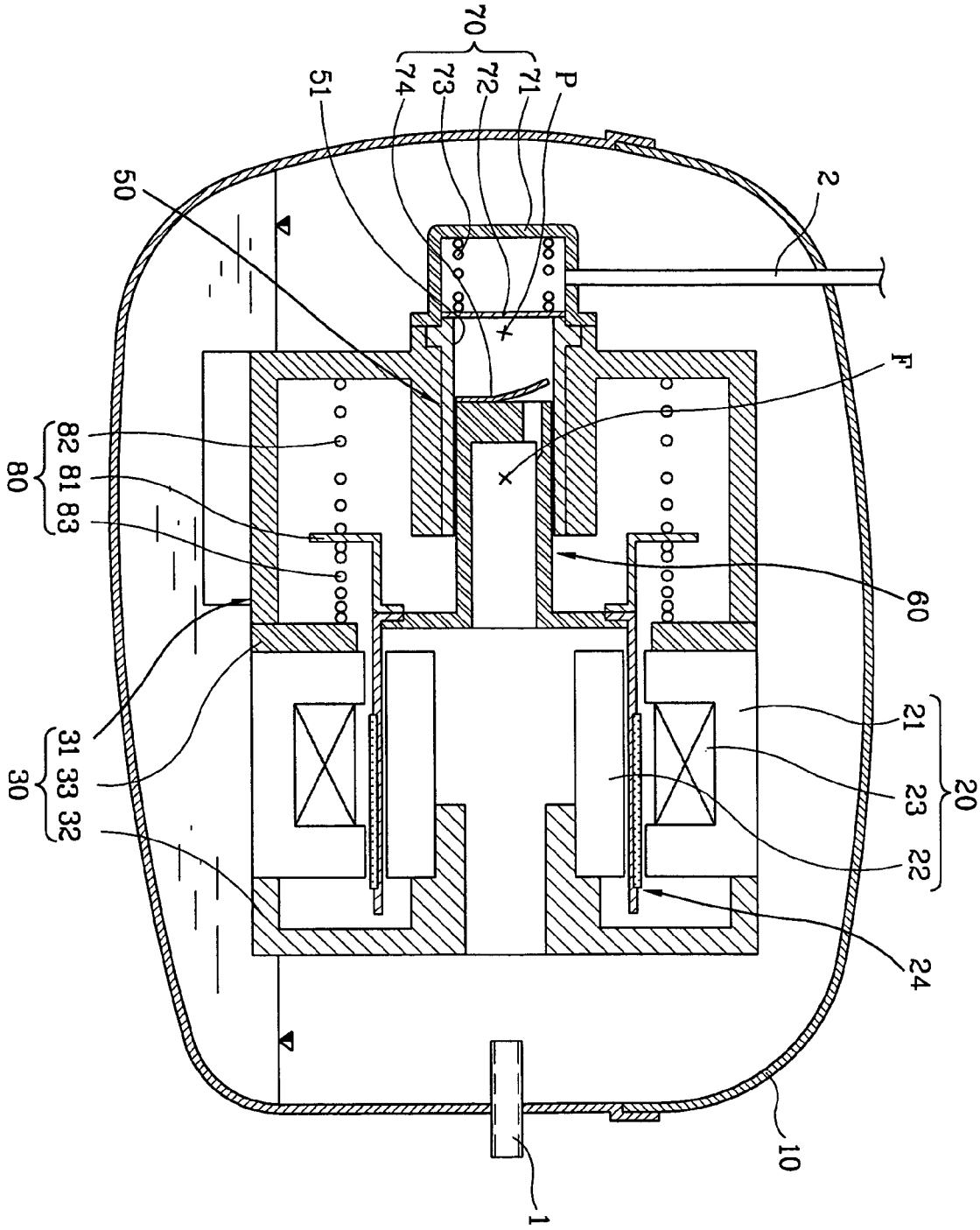
FIG. 3 PRIOR ART
FIG. 3 is a transverse-sectional view illustrating impact of the piston of the reciprocating compressor in FIG. 1 at a bottom dead center.
Figure 4:
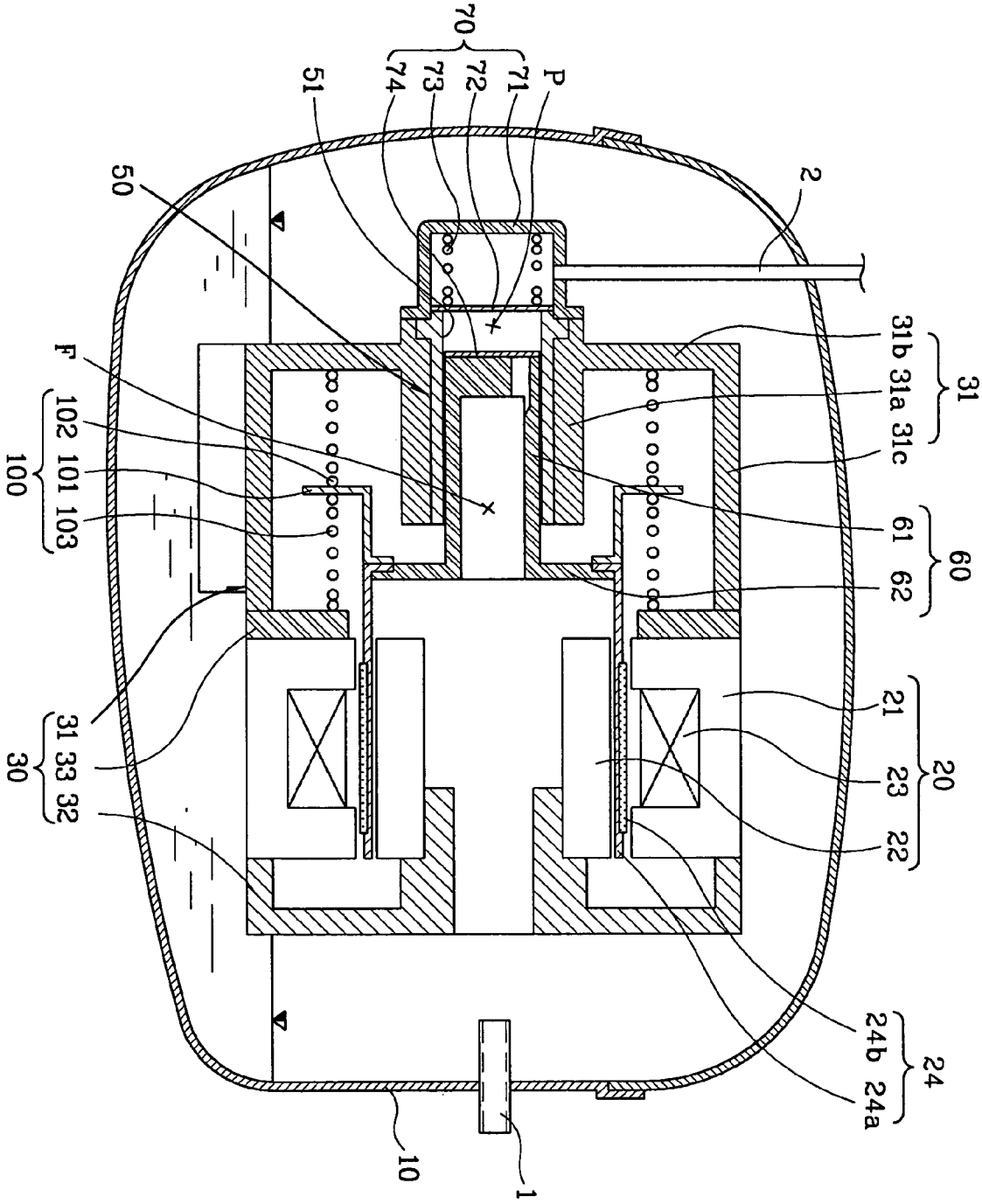
FIG. 4 is a transverse-sectional view illustrating a reciprocating compressor in accordance with the present invention.
Figure 5:
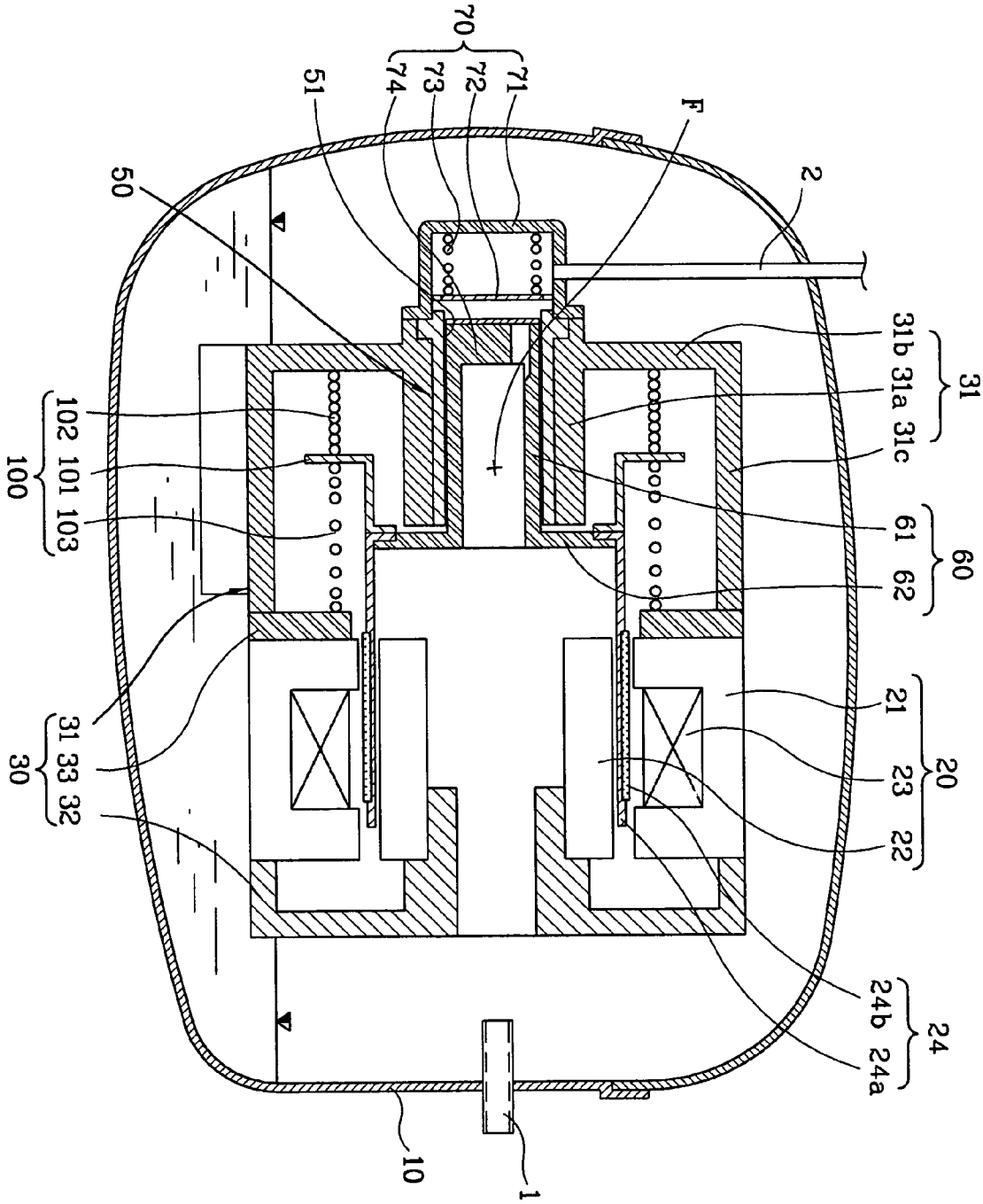
FIG. 5 is a transverse-sectional view illustrating an operation of a piston of the reciprocating compressor in FIG. 4 at a top dead center.
Figure 6:
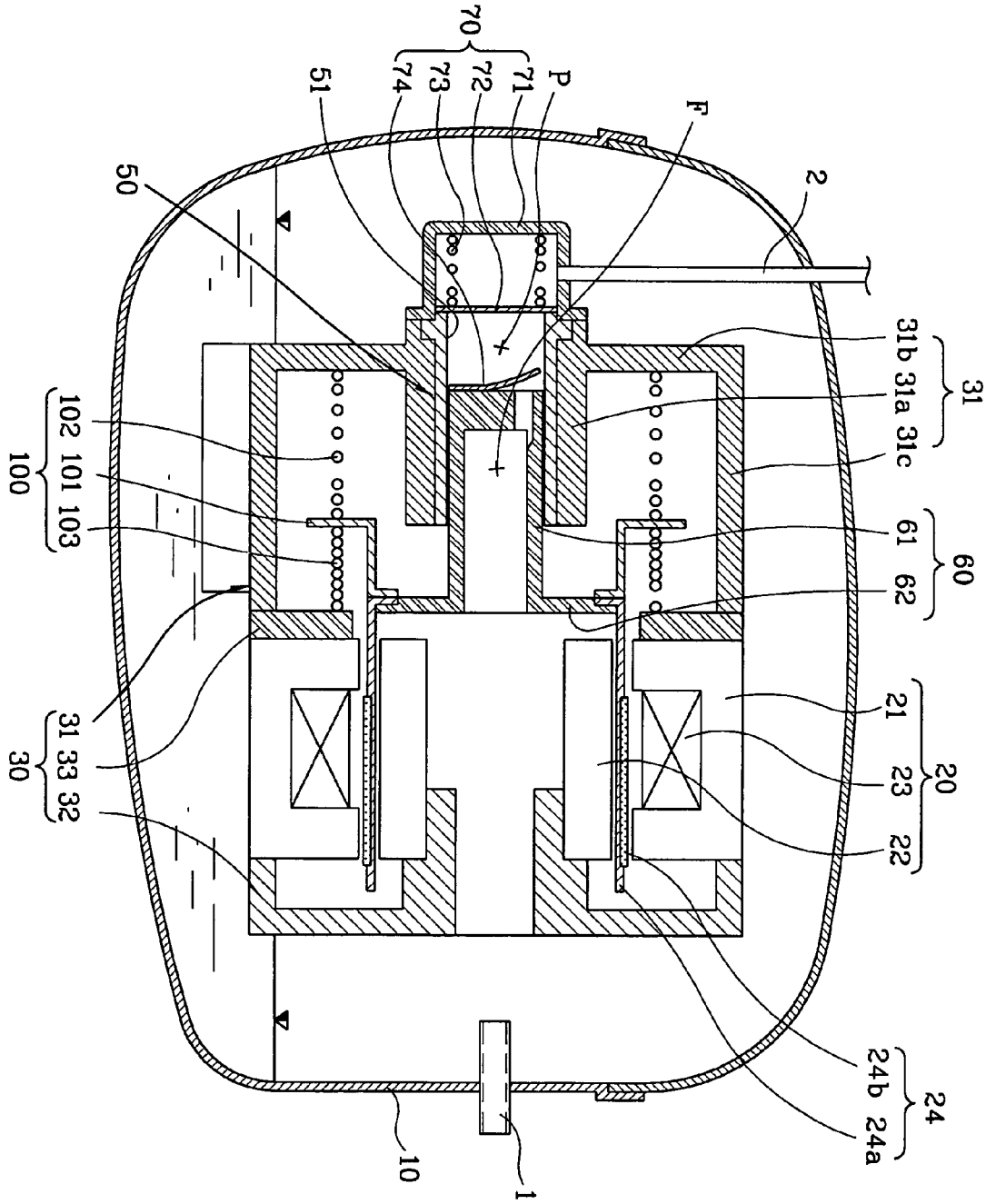
FIG. 6 is a transverse-sectional view illustrating an operation of the piston of the reciprocating compressor in FIG. 4 at a bottom dead center.

FIG. 4 is a transverse-sectional view illustrating a reciprocating compressor in accordance with the present invention, FIG. 5 is a transverse-sectional view illustrating an operation of a piston of the reciprocating compressor in FIG. 4 at a top dead center, and FIG. 6 is a transverse-sectional view illustrating an operation of the piston of the reciprocating compressor in FIG. 4 at a bottom dead center.

As depicted in FIGS. 4~6, the reciprocating compressor in accordance with the present invention includes a container 10 having a gas suction pipe 1 and a gas discharge pipe 2; a frame unit 30 disposed in the container 10; a reciprocating motor 20 installed in the frame unit 30 in order to generate a driving force; a cylinder 50 installed at the center of the frame unit 30 and having an installation hole 51; a piston 60 performing a linear reciprocating motion into and out of the cylinder 50 by the driving force of the reciprocating motor 20; a valve unit 70 installed at the front of the frame unit 30 and the piston 60 so as to suck/discharge gas into the cylinder 50 by using pressure difference generated by the linear reciprocating motion of the piston 60; and a spring unit 100 installed at the frame unit 30 in order to support the linear reciprocating motion of the piston 60 elastically.

The frame unit 30 consists of a front and a rear frames 31, 32 respectively installed at the internal front and the internal rear of the casing 10 and a middle frame 33 installed between the front and the rear frames 31, 32.

The front frame 31 consists of a frame body portion 31*a* having a certain length; a plate portion 31*b* extended from a side of the frame body portion 31*a* so as to have a certain area; and a supporting portion 31*c* circumferentially extending from the plate portion 31*b* so as to have a certain length and support the middle frame 33.

The reciprocating motor 20 includes an outer stator 21 fixed between the middle frame 31 and the rear frame 30; an inner stator 22 inserted into the outer stator 21 and spaced from the outer stator by a predetermined interval; and a wound coil 23 wound around the outer stator 21 and a mover 24 installed between the outer stator 21 and the inner stator 22 and connected to the piston 60 so as to perform a linear reciprocating motion.

The mover 24 consists of a magnetic holder 24*a* having a cylindrical shape; and plural permanent magnets 24*b* combined with the magnetic holder at regular intervals.

The cylinder 50 is horizontally installed at the center of the front frame 31 and maintains a certain interval with the reciprocating motor 20.

The piston 60 is inserted into a through hole 51 of the cylinder 50 so as to form a compression chamber (P), and the end of the piston 60 is connected to the mover 24.

The piston consists of an internal gas suction flow channel (F), a piston body portion 61 inserted into the through hole 51 of the cylinder 50; and a flange portion 62 circumferentially extending at the end of the body portion 61 so as to have a certain area and secured to the magnetic holder 23*a*.

The valve unit 70 includes a discharge cover 71 for covering the compression chamber (P) of the cylinder 60; a discharge valve 72 arranged inside the discharge cover 71 and opening/closing the compression chamber (P); a valve spring 73 for supporting the discharge valve 72 elastically; and a suction valve 74 combined with the front of the piston 60 and opening/closing a gas suction flow path (F) formed inside the piston 60.

The spring unit 100 includes a spring support 101 fixed to a certain side of the piston 60; a front coil spring 102 having a certain length and arranged between the front frame 31 and the spring support 101; and a rear coil spring 103 having a certain length and arranged between the middle frame 33 and the spring support 101.

The spring unit 100 will be described in more detail.

The spring support 101 is fixed to the rear of the piston 60 and is moved together with the piston 60 during the linear-reciprocating motion of the piston 60.

The front coil spring 102 is installed between the front frame 31 and the spring support 101 so as to have a certain length, and the rear spring 103 is installed between the middle frame 33 and the spring support 101 so as to have a certain length.

Both the front spring 102 and the rear spring 103 respectively have a predetermined fully compressed length, (i.e., when adjacent coils abut against each other). The fully compressed spring lengths are determined to be within a stroke distance of the piston 60 so as to prevent the piston 60 from colliding against other construction parts.

Right before the piston 60 reaches a top dead center position in moving forward, the front spring 102 is gradually compressed by the spring support 101. When the piston reaches the top dead center, the front spring is fully compressed to have a solid length with adjacent coils abutting against each other.

In the solid length state of the front spring 102, in more detail, when the piston 60 compresses the compression chamber (P) fully (the top dead center position of the piston), the front spring 102 cannot be compressed any more, and the piston 60 can not proceed any more.

Accordingly, because the piston 60 does not contact to the other construction parts, it is possible efficiently to prevent breakage of not only the piston 60 but also the other construction parts abutting on the piston 60.

In addition, right before the piston 60 reaches a bottom dead center position in retreating (i.e., in moving rearwardly), the rear spring 103 is gradually compressed by the spring support 101. When the piston 60 reaches the bottom dead center, the rear spring 103 is fully compressed to have a solid length with adjacent coils abutting against each other.

In the solid length state of the rear spring 103, in more detail, in the bottom dead center position of the piston 60, the rear spring 103 cannot become compressed any more, and the piston 60 can not move rearwardly any more.

Accordingly, because the piston 60 does not contact to the other construction parts, it is possible to efficiently prevent breakage of not only the piston 60 but also the other construction parts abutting on the piston 60.

Hereinafter, advantages of the reciprocating compressor in accordance with the present invention will be described.

First, the operation of the reciprocating compressor will be described briefly. When power is supplied to the reciprocating motor 20 and a current flows in the wound coil 23, the mover 24 performs the linear-reciprocating motion by mutual operation of magnetic flux formed by the outer and inner stators 21, 22 and the permanent magnet 24*b*.

Herein, the piston 60 connected to the mover 24 performs the linear-reciprocating motion into and out of the through hole 51 of the cylinder 50.

At the same time, gas is sucked through the suction pipe 1 of the container 10 and the suction flow path (F) of the piston 60, flows into the compression chamber (P) by the operation of the valve unit 70 and is discharged through the discharge pipe 2, and that operation is performed repeatedly.

Herein, the resonance spring unit 100 stores, discharges the linear reciprocating motion of the reciprocating motor 20 as elastic energy and simultaneously induces a resonance motion.

In addition, although the piston 60 might be driven for an inappropriate stroke distance due to errors in the stroke distance control of the piston 60 or the fabrication and assembly process, etc., in the present invention, by the solid length of the front and rear springs 102, 103, it is possible to efficiently prevent breakage of not only the piston 60 but also the other construction parts abutting on the piston 60.

In more detail, right before the piston 60 reaches the top dead center position in moving forward, the front spring 102 is gradually compressed by the spring support 101. When the piston 60 reaches the top dead center position, the front spring is fully compressed to have a solid length.

Herein, the rear spring 103 compresses the spring support 101 toward the front by the elastic restoring force, in the solid length state of the front spring 102, the rear spring 103 compresses the spring support 101 only with small elastic repulsive force.

In the solid length state of the front spring 102, in more detail, when the piston 60 fully compresses the compression chamber (P), the front spring 102 cannot be compressed any more, the piston 60 can not proceed any more.

Herein, because the piston 60 and the front frame 102 or abutting construction parts are not contacted with each other, breakage due to impact against the piston 60 can be efficiently prevented.

In addition, right before the piston 60 reaches the bottom dead center while moving backward, the rear spring 103 is gradually compressed by the spring support 101 When the piston 60 reaches the bottom dead center, the rear spring 103 is fully compressed to have a solid length. Herein, the front spring 102 gradually compresses the spring support 101 toward the rear by the elastic restoring force.

In the solid length state of the rear spring 103, in more detail, because the rear spring 103 cannot be compressed any more in the bottom dead center position, the piston 60 can not move rearwardly any more.

Herein, because the piston 60 and the front frame 102 or the construction parts abutting on the piston 60 are not contacted with each other, breakage due to collision against the piston 60 can be efficiently prevented.

As described above, in the present invention, by respectively installing the front coil spring and the rear coil spring at the front and rear of the piston, the piston is elastically supported, a stroke distance of the piston is limited, and accordingly it is possible to efficiently prevent breakage of the piston and other construction parts abutting on the piston.

What is claimed is:

1. A reciprocating compressor, comprising:

a container having a gas suction pipe and a gas discharge pipe;

a frame unit disposed in the container;

a reciprocating motor secured to the frame unit to generate a driving force;

a piston arranged so as to perform a linear reciprocating motion with respect to a cylinder by the driving force of the reciprocating motor;

a valve unit installed at the frame unit so as to discharge gas by using pressure difference generated by the linear reciprocating motion of the piston; and a front elastic member arranged on a front of the frame unit in order to support the piston elastically and prevent breakage of construction parts abutting on the piston when the piston moves over a top dead center position, wherein the front elastic member is in a solid fully compressed state and a rear elastic member pushes a spring support toward the front elastic member with an elastic force thereof when the piston reaches a top dead center position, the rear elastic member is in a solid fully compressed state and the front elastic member pushes the spring support toward the rear elastic member with an elastic force thereof when the piston reaches a bottom dead center position, and the spring support is positioned between the front elastic member and the rear elastic member.

2. The compressor of claim 1, wherein the front elastic member is a coil spring.

3. The compressor of claim 1, wherein the rear elastic member is a coil spring.

* * * * *

UNITED STATES PATENT AND TRADEMARK OFFICE

CERTIFICATE OF CORRECTION

PATENT NO. : 7,108,490 B2
APPLICATION NO. : 10/383628
DATED : September 19, 2006
INVENTOR(S) : Ki-Won Noh et al.

It is certified that error appears in the above-identified patent and that said Letters Patent is hereby corrected as shown below:

Title Page;
On the cover of the printed patent, Item (56), References Cited (Other Publications), "English Language Abstract of KE 10-2000-0040150" should read --English Language Abstract of KR10-2000-0040150--.

On the cover of the printed patent, Item (54), Title, "RECIPROCATING COMPRESSOR HAVING ANTI-COLLISION MEANS" should read --RECIPROCATING COMPRESSOR--.

On the cover of the printed patent, Item (56), References Cited (Other Publications), add the following, "English Language Abstract of DE 10055954".

Signed and Sealed this

Eighth Day of April, 2008

JON W. DUDAS
*Director of the United States Patent and Trademark Office*

UNITED STATES PATENT AND TRADEMARK OFFICE

CERTIFICATE OF CORRECTION

PATENT NO. : 7,108,490 B2
APPLICATION NO. : 10/383628
DATED : September 19, 2006
INVENTOR(S) : Ki-Won Noh et al.

It is certified that error appears in the above-identified patent and that said Letters Patent is hereby corrected as shown below:

Title Page;
On the cover of the printed patent, Item (56), References Cited (Other Publications), "English Language Abstract of KE 10-2000-0040150" should read --English Language Abstract of KR10-2000-0040150--.

On the cover of the printed patent, Item (54), and Column 1, lines 1 and 2 Title, "RECIPROCATING COMPRESSOR HAVING ANTI-COLLISION MEANS" should read --RECIPROCATING COMPRESSOR--.

On the cover of the printed patent, Item (56), References Cited (Other Publications), add the following, "English Language Abstract of DE 10055954".

This certificate supersedes the Certificate of Correction issued April 8, 2008.

Signed and Sealed this

Sixth Day of May, 2008

JON W. DUDAS
*Director of the United States Patent and Trademark Office*